US006384804B1

(12) United States Patent
Dodabalapur et al.

(10) Patent No.: US 6,384,804 B1
(45) Date of Patent: May 7, 2002

(54) DISPLAY COMPRISING ORGANIC SMART PIXELS

(75) Inventors: Ananth Dodabalapur, Millington; Rahul Sarpeshkar, Chatham, both of NJ (US)

(73) Assignee: Lucent Techonologies Inc., Murray Hill, NJ (US)

( * ) Notice: Subject to any disclaimer, the term of this patent is extended or adjusted under 35 U.S.C. 154(b) by 0 days.

(21) Appl. No.: 09/199,364

(22) Filed: Nov. 25, 1998

(51) Int. Cl.[7] ..... G09G 3/32

(52) U.S. Cl. ..... 345/82; 345/76; 345/205; 257/40

(58) Field of Search ..... 345/82, 76, 55, 345/205–206, 44–46; 313/483, 498; 315/169.1, 169.3, 169.4; 257/40

(56) References Cited

U.S. PATENT DOCUMENTS

| | | | | | |
|---|---|---|---|---|---|
| 5,405,710 | A | | 4/1995 | Dodabalapur et al. | 428/690 |
| 5,478,658 | A | | 12/1995 | Dodabalapur et al. | 428/690 |
| 5,574,291 | A | | 11/1996 | Dodabalapur et al. | 257/40 |
| 5,596,208 | A | | 1/1997 | Dodabalapur et al. | 257/66 |
| 5,625,199 | A | | 4/1997 | Baumbach et al. | 257/40 |
| 5,719,589 | A | * | 2/1998 | Norman et al. | 345/82 |
| 5,903,246 | A | * | 5/1999 | Dingwall | 345/82 |
| 5,998,805 | A | * | 12/1999 | Shi et al. | 257/40 |
| 6,023,259 | A | * | 2/2000 | Howard et al. | 345/76 |
| 6,150,668 | A | * | 11/2000 | Bao et al. | 257/40 |
| 6,157,356 | A | * | 12/2000 | Troutman | 345/82 |
| 2001/0026251 | A1 | * | 10/2001 | Hunter et al. | 345/55 |

FOREIGN PATENT DOCUMENTS

| | | | | |
|---|---|---|---|---|
| EP | 0755042 | A1 | 1/1997 | G09G/3/22 |
| EP | 0905673 | A1 | 3/1999 | G09G/3/32 |
| WO | WO9848403 | | 10/1998 | G09G/3/10 |

OTHER PUBLICATIONS

Rothberg, L. et al. "Resonant–Cavity Electroluminescent Backlights", SID Digest, vol. XXIX, pp. 231–234, May 1998.*

Sirringhaus et al., *Science*, "Integrated Optoelectronic Devices Based on Conjugated Polymers", vol. 280, Jun. 12, 1998, pp. 1741–1744.

A. Dodabalapur, "Organic Light Emitting Diodes", *Solid State Communications*, vol. 102, No. 2–3, 1997, pp. 259–267.

M. K. Hatalis, "Polysilicon TFT Active Matrix Organic EL Displays", *Proceedings of the SPIE*, vol. 3057, 1997, pp. 277–286.

C. C. Wu et al., "Integration of Organic LED's and Amorphous Si TFT's onto Flexible and Lightweight Metal Foil Substrates", *IEEE Electron Device Letters*, vol. 18, 1997, pp. 609–612.

A. Dodabalapur et al., "Organic Smart Pixels", *Applied Physics Letters*, vol. 73(2), Jul. 1998, pp. 142–144.

H. Sirringhaus et al., "Integrated Optoelectronic Devices Based on Conjugated Polymers", *Science*, vol. 280 Jun. 12, 1998, pp. 1741–1744.

* cited by examiner

*Primary Examiner*—Richard Hjerpe
*Assistant Examiner*—Francis Nguyen
(74) *Attorney, Agent, or Firm*—John F. McCabe; Eugen E. Pacher

(57) ABSTRACT

A display apparatus according to our invention comprises a multiplicity of nominally identical smart pixels, a given pixel comprising an organic light emitting diode and an organic or inorganic (e.g., amorphous or polycrystalline Si) pixel FET. The display also comprises drive/compensation circuitry adapted for mitigating or eliminating non-idealities associated with the organic components. Among the non-idealities are variations in mobility and/or threshold voltage of the pixel FET from transistor to transistor, change in mobility and/or threshold voltage with time in a given pixel FET, change over time of the LED characteristics, capacitive signal feed-through through the gate insulator of the pixel FETs by short rise/fall time pulses, poor on-off ratio of the pixel FET, and charge leakage through the gate dielectric. Exemplary drive/compensation circuitry is disclosed.

16 Claims, 7 Drawing Sheets

DISPLAY COMPRISING ORGANIC SMART PIXELS

FIELD OF THE INVENTION

This invention pertains to active matrix displays comprising organic light emitting elements.

BACKGROUND OF THE INVENTION

Displays that comprise smart pixels are known. Typically, a smart pixel comprises a light-emissive element and a circuit that comprises one or more field effect transistors (FETs) which drives/switches the emissive element. A given pixel typically is addressed by several conductor lines which typically are connected to peripherally disposed drive circuitry.

Recently organic light emissive elements (typically organic light emitting diodes; see, for instance, A. Dodabalapur, *Solid State Communication*, Vol. 102, No. 2–3, pp. 259–267, 1997) have been disclosed, and have been proposed for use in displays. See, for instance, M. K. Hatalis et al., *Proceedings of the SPIE*, 3057, p. 277 (1997), and C. C. Wu et al., *IEEE Electron Device Letters*, Vol. 18, p. 609 (1997). The references disclose smart pixels with organic light emitting diodes (LEDs) and field effect transistors (FETs) with, respectively, polycrystalline and amorphous Si active channel material.

Furthermore, displays that comprise organic smart pixels have also been proposed. See, for instance, Dodabalapur et al., *Applied Physics Letters*, Vol. 73(2), July 1998, pp. 142–144, and U. S. patent application Ser. No. 09/087,201, filed May 29, 1998 by Bao et al. See also H. Sirringhaus et al., *Science*, Vol. 280, page 1741, Jun. 12, 1998. In such a display, a given pixel not only comprises an organic light emitting diode (LED) but also one or more organic pixel FETs.

Active matrix displays with organic LEDs and organic pixel transistors potentially have significant advantages, e.g., low cost and compatibility with flexible plastic substrates.

We have come to realize that components such as organic LEDs and organic pixel FETs frequently exhibit certain limitations and/or non-ideal characteristics (collectively "non-idealities") that can adversely affect the performance of otherwise potentially excellent displays.

For instance, we have discovered that charge carrier mobility and/or threshold voltage of organic LEDs frequently change slowly with time, that charge carrier mobility and/or threshold voltage of organic FETs frequently vary from FET to FET, and that organic pixel FETs frequently are subject to capacitive signal feedthrough through the gate insulator and to charge leakage because of standby currents when transistors are off. These and other non-idealities can result in displays with significant brightness variations and/or other shortcomings. Such variations will frequently be unacceptable, especially in view of the known sensitivity of the human eye to brightness variations. FETs with polycrystalline or amorphous Si active channel material also frequently exhibit non-idealities.

In view of the potential advantages of active matrix displays with organic smart pixels, it would be highly desirable if at least some of the non-idealities could be mitigated or eliminated. This application discloses some significant non-idealities, and also discloses means for overcoming them.

The following U. S. patents and applications pertain to related subject matter: U.S. Pat. Nos. 5,405,710; 5,478,658; 5,574,291; 5,625,199; and 5,596,208; application Ser. No. 08/441,142, filed May 15, 1995 by Dodabalapur et al; application Ser. No. 09/087,201, filed May 29, 1998 by Bao et al; and application Ser. No. 09/137,920, filed Aug. 20, 1998 by Dodabalapur.

All references that are cited herein are incorporated herein by reference.

SUMMARY OF THE INVENTION

In a broad aspect the instant invention is embodied in an active matrix display wherein a given pixel comprises at least one organic component, typically an organic LED. The pixel typically further comprises at least one organic or Si-based pixel FET (e.g., polycrystalline Si FET or amorphous Si FET). Associated with the presence in the pixel of one or more organic, polycrystalline Si or amorphous Si components are some non-idealities.

There are at least two types of non-idealities. One type is due to non-ideal device characteristics of the organic transistors and requires corrective action for each smart pixel, typically at the frame frequency (exemplarily about 75 Hz). Exemplary of the first type of non-ideality are capacitive signal feed-through through the gate insulators of organic pixel FETs by short rise/fall time pulses and charge leakage due to relatively low on-off ratios of organic transistors.

The other type of non-ideality is due to, typically slow, changes in physical characteristics (e.g., mobility, threshold voltage) of the organic components, and requires only intermittent corrective action (e.g., when the display is activated, and/or at predetermined intervals that are much longer than the frame period, for instance, once a day).

In order to mitigate or overcome some or all of the non-idealities, a display according to the invention comprises circuitry, at least part of which is typically disposed in the periphery of the display, that inter alia performs various compensatory functions. This circuitry will be referred to as the "drive/compensation" circuitry.

Drive/compensation circuitry for mitigating the first type of non-idealities will typically comprise additional FETs (i.e., FETs in addition to the conventional pixel FET) that act to mitigate or eliminate, for instance, the capacitive signal feed-through, charge leakage or other non-ideality of prior art smart pixels. The drive/compensation circuitry for mitigating the second type of non-ideality will typically comprise means for periodically measuring and storing appropriate characteristics of each smart pixel (exemplarily the voltage that is required to produce a certain current through the LED, and/or the threshold voltage). This information typically is stored in an electronic memory, and the drive/compensation circuitry adjusts the drive conditions of each pixel that deviates from target conditions, taking into account the traits of the individual pixels.

Those skilled in the art will recognize that the above-described approaches to mitigation of smart pixel non-idealities are, inter alia, possible because the precision and accuracy of conventional Si-based circuits typically are much greater than those of organic-based circuits. Thus, at least part of the drive/compensation circuitry according to our inventive is preferably embodied in Si technology, typically conventional C-MOS technology.

Among the non-idealities of pixels with one or more organic components typically are a) variations in mobility and/or threshold voltage of the organic pixel FETs from transistor to transistor;

b) change in mobility and/or threshold voltage with time in a given pixel FET;

c) change over time of the LED characteristics;

d) capacitive signal feed-through through the gate insulator of the organic pixel FETs by short rise/fall time pulses; and e) charge leakage through the gate dielectric due to poor on-off ratio of the organic pixel FET.

Of the above-cited non-idealities, non-idealities a), b) and c) typically require corrective action at a frequency much below the frame frequency of the display, and non-idealities d) and e) typically require corrective action for each pixel at the frame frequency. The former will frequently be referred to as "adaptive pixel control".

More specifically, the invention exemplarily is embodied in display apparatus that comprises a multiplicity of nominally identical smart pixels disposed on a first substrate region, and that further comprises a smart pixel-free second substrate region. A given smart pixel comprises an organic light emitting diode, and pixel circuitry for providing a current through the organic light emitting diode. The pixel circuitry of the given smart pixel comprises at least one pixel FET (typically, but not necessarily, an organic pixel FET) in series with the organic light emitting diode and disposed in the first substrate region.

Significantly, the nominally identical smart pixels unintentionally exhibit one or more non-idealities that adversely affect the performance of the display apparatus. The display apparatus further comprises drive/compensation circuitry selected to at least mitigate said one or more non-idealities, such that the performance of said display apparatus is improved.

Typically, the field effect transistor in series with the organic LED is an organic FET (but could be a polycrystalline or amorphous Si FET), and the drive/compensation circuitry typically comprises single crystal Si (exemplarily conventional C-MOS) circuitry.

By way of example, the drive/compensation circuitry is selected such that compensating charge injection into the gate terminal of the organic FET mitigates capacitive signal feed-through or such that setting an inactive high value of a ROW signal and a RST signal to a value above a supply voltage $V_{dd}$ mitigates charge leakage.

By way of further example, the drive/compensation circuitry is selected to measure and store one or more characteristics of each smart pixel, and to make, if indicated by the result of the measurements, a change in the control voltage such that substantially all smart pixels have substantially the same light emission for a given signal provided to the display apparatus.

The figures are not to scale or in proportion.

DETAILED DESCRIPTION

Figure 1:
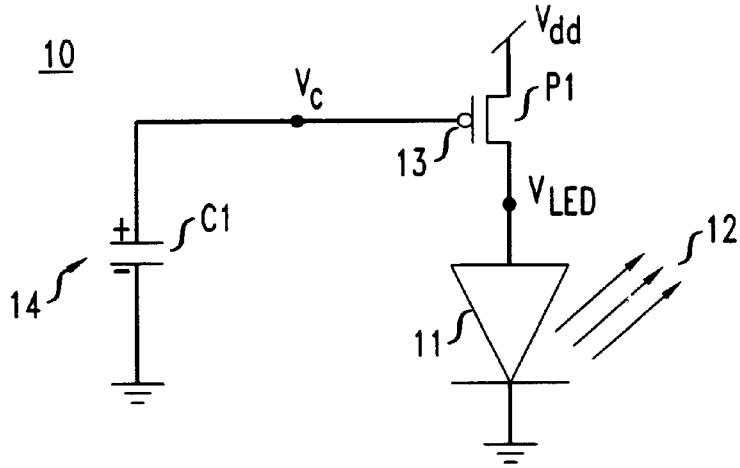
FIG. 1 (PRIOR ART)
FIG. 1 schematically shows an exemplary prior art organic smart pixel including a pixel FET.

FIG. 1 shows a prior art organic smart pixel 10, wherein numerals 11–14 refer, respectively, to the organic LED, the light output of the LED, the organic pixel FET P1, and control capacitor C1 for applying a control voltage $V_c$ to the gate of the pixel FET. Supply voltage $V_{dd}$ and LED drive voltage $V_{LED}$ are also indicated. The smart pixel of FIG. 1 substantially corresponds to the smart pixel of FIG. 1 of the above-cited article by Dodabalapur et al. The pixel circuitry of FIG. 1 is disposed proximate to the given organic LED in the first substrate region.

Figure 2:
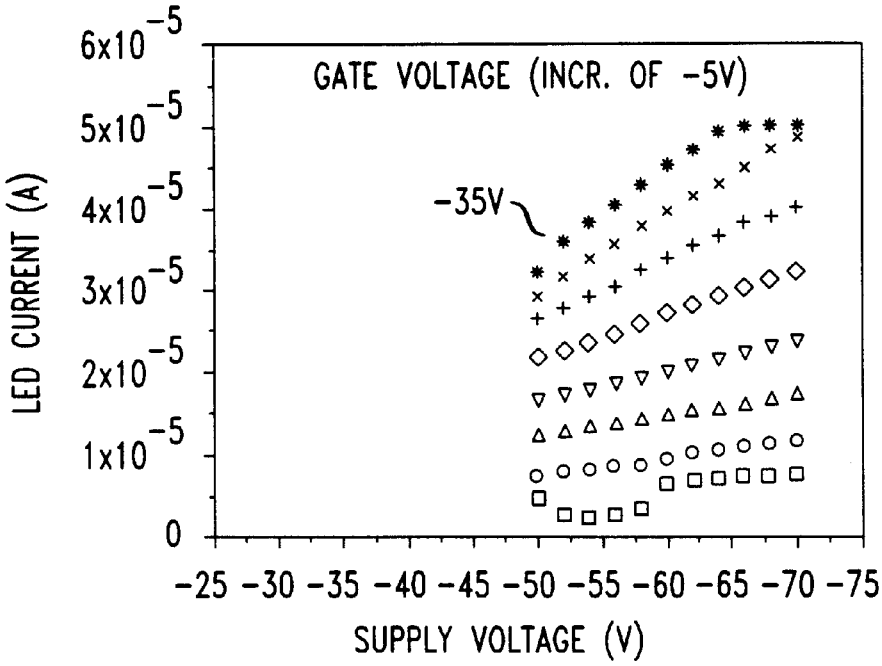
FIG. 2 (PRIOR ART)
FIG. 2 shows electrical characteristics of an exemplary prior art organic smart pixel.

FIG. 2 shows the electrical characteristics (LED current vs. supply voltage, for various gate voltages) of an exemplary prior art smart pixel as shown in FIG. 1 herein. Nominally identical smart pixels frequently have characteristics that are qualitatively the same as those of FIG. 2 but differ quantitatively therefrom.

Figure 3:
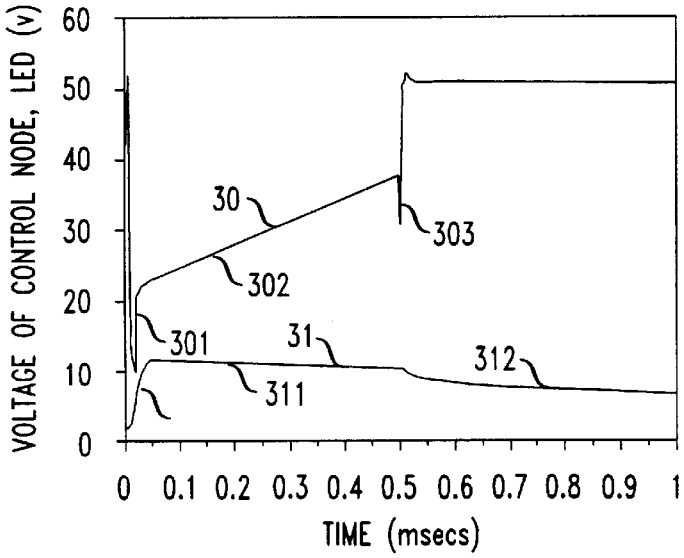
FIG. 3 (PRIOR ART)
FIG. 3 shows computed data of control node voltage vs. time of an exemplary prior art organic smart pixel.

FIG. 3 shows results of a computer simulation (using conventional SPICE circuit simulation software and representative device parameter values) of organic smart pixel behavior. The simulation substantially reproduces relevant aspects of the behavior of the prior art organic smart pixel of FIG. 1 herein, and shows the dynamics of $V_c$ and $V_{LED}$ (curves 31 and 30, respectively) when a 10 $\mu$s active pulse is applied to the gate of the organic FET. The simulation of FIG. 3 shows significant non-idealities. Specifically, numerals 301 and 303 refer to sharp dips in $V_{LED}$ due to capacitive signal feed-through, and numerals 302 and 311 refer to pronounced changes with time, in, respectively, $V_{LED}$ and $V_C$, due to charge leakage. Numeral 312 refers to a slope due to normal diode capacitor decay in $V_C$.

Capacitive Signal Feed-Through, Charge Leakage and Low Off-On Ratio

Figure 4:
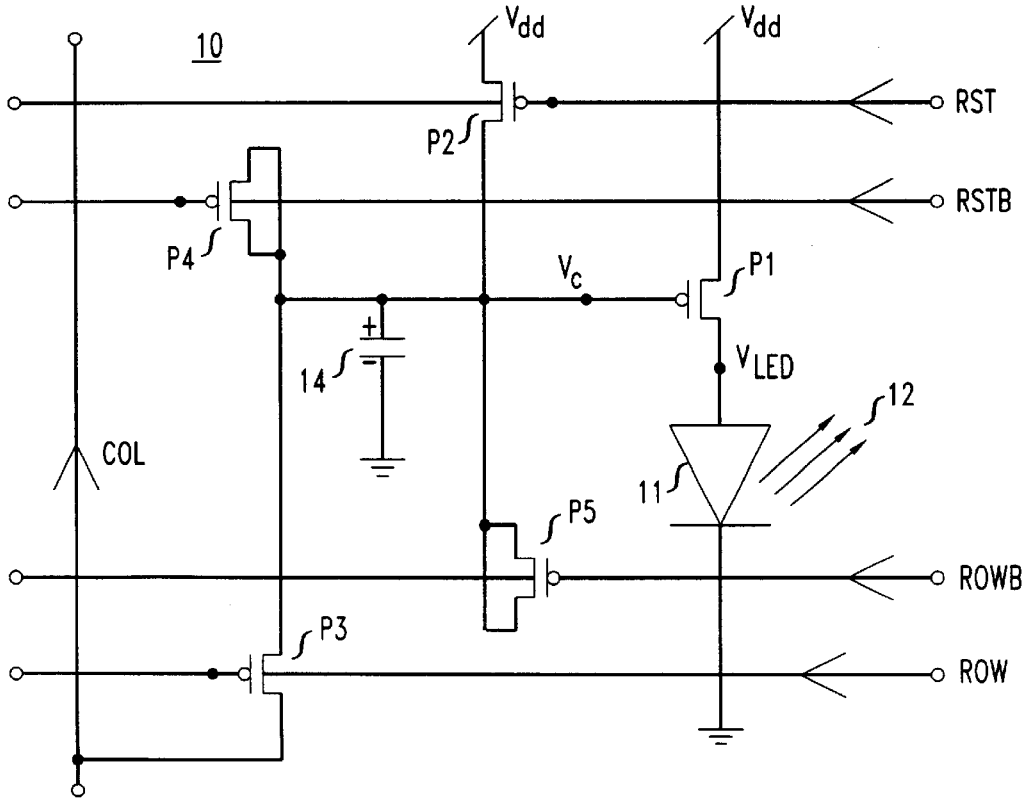
FIG. 4 schematically shows an organic smart pixel with exemplary drive/compensation circuitry adapted for at least mitigating non-idealities such as capacitive signal feed-through, and charge leakage.

FIG. 4 shows, in addition to the organic components 11 and 13, exemplary drive/compensation circuitry for a pixel, the circuitry designed to compensate for the parasitic effects of charge injection and leakage that we have found associated with prior art organic smart pixels. It will be understood that the components that are shown in FIG. 4 need not be co-located, but typically are disposed near a given LED.

Organic LED 11 is controlled by organic FET P1, whose gate voltage $V_c$ determines the LED current. Transistor P2 resets $V_c$ to $V_{dd}$ via a short active-low pulse on RST. The transistor P4 has a W/L (width-to-length) ratio that is half of the W/L ratio of transistor P2, and receives an inverted version of the RST pulse on the RSTB control line. The transistor P4 and RSTB cancel the undesirable charge injected onto $V_c$ by P2's gate-to-drain overlap capacitance during the sharp edges of the RST pulse. When RST transitions, RSTB makes a complementary transition, and a compensating charge of the opposite sign is injected onto $V_c$ by P4's gate-drain and gate-source capacitances. The transistor P3 discharges control capacitor C1 to a voltage determined by the width of the active-low pulse on the ROW line and the value of a driving current/voltage source on COL. Transistor P5 and the control line ROWB serve to perform charge compensation for the ROW pulse in a manner analogous to the compensation performed by transistor P4 and RSTB for the RST pulse.

The off currents of P2 and P3 cause charge leakage and degrade the held value of $V_c$. Exemplarily this can be alleviated by setting the inactive high values of the ROW and RST signals to be significantly above $V_{dd}$. Thus, if $V_{dd}$ =40V, the inactive high values of ROW and RST exemplarily are about 50V, thereby ensuring that the gate-to-source voltages of transistors P2 and P3 are very negative, rather than just zero, and consequently that the leakage currents of these transistors are negligible. The simple expedient of setting the inactive high values of ROW and RST to values above $V_{dd}$ effectively compensates for charge leakage, and is considered a significant feature of the invention.

It will be appreciated that drive/compensation circuitry as shown in FIG. 4 (or an equivalent thereof) is associated with each organic smart pixel of a display, and provides compensation for non-idealities every time a given pixel is addressed or reset. The circuitry optionally is implemented with organic FETs, and typically is disposed proximate to the LED, in the first substrate region.

It will also be appreciated that FIG. 4 does not show such conventional features as a power supply between $V_{dd}$ and ground, and the substrate terminals of transistors P2–P5. The latter are considered to be tied to ground, as is conventional. The symbols used in FIG. 4 are conventional. For instance, all p-MOS FETs have designations that start with "P" (P1, P2, P3 . . . etc.), and the complement for a given signal has the designation of the given signal, followed by "B". For instance, the complement of "RST" is designated "RSTB". These conventions are followed throughout the application.

Figure 5:
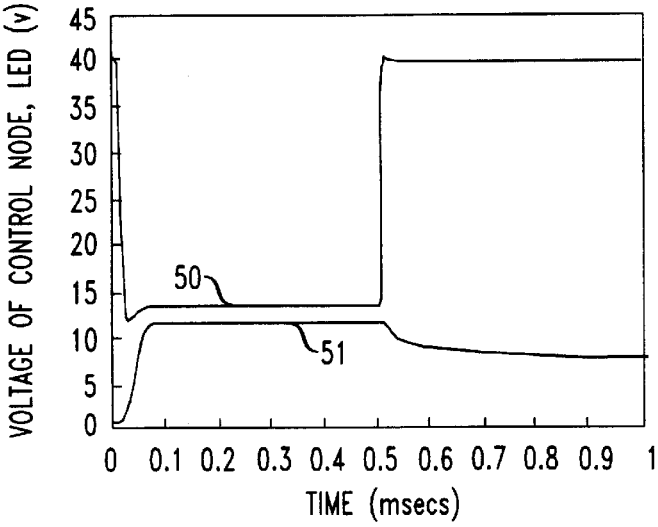
FIG. 5 shows computed data of control node voltage vs. time of the smart pixel with drive/compensation circuitry of FIG. 4.

FIG. 5 shows exemplary results of a SPICE simulation of the organic smart pixel of FIG. 4. The simulation assumed device characteristics as used in the simulation of the prior art pixel (FIG. 3), but with dummy charge compensation (RSTB, P4, ROWB and P5 are present) and charge leakage compensation (inactive high values of ROW and RST signals are at 50V although $V_{dd}$ =40V) present. As can be readily seen, the capacitive glitches and charge leakage are drastically reduced. Reference numerals 50 and 51, refer respectively, to $V_c$ and $V_{LED}$.

As can be seen from FIGS. 3 and 5, control voltage $V_c$ equilibrates to its final value very quickly, typically within the 10$\mu$s pulse width. The LED voltage $V_{LED}$ charges quickly (typically within 50$\mu$s) from a low value to a high value in a time that is well within one refresh cycle for a frame (exemplarily 14 ms). The decay of $V_{LED}$ from a high value to a lower value is slower than would be expected from the asymmetry of the LED. However, the actual current, and consequently the light emitted by the LED, is a strong power law function of the voltage and decays much more rapidly. Thus, in FIG. 3, although the voltage takes several milliseconds to decay by a few volts, the current drops rapidly to zero, typically within 100$\mu$s of the reset of $V_c$.

The device parameters that were used in the simulations are: a 1000 $\mu$m/6 $\mu$m organic FET with mobility of 0.03 $cm^2$ /V·sec, threshold of −2, 100 nm gate dielectric, overlap capacitances of 2fF/$\mu$m, current of 100 $\mu$A at 12V for a 1 mm×1 mm organic LED with dielectric constant of 3, dielectric thickness of 100 nm, and a 9th-power I-V characteristic above 8V. These parameters are, we believe, representative of real device operation.

The simulations show that organic smart pixels as discussed are easily capable of operation at the speeds that are necessary for displays. For instance, the LED charging and discharging time scale is well within the typical 14 ms refresh rate for a 1000×1000 pixel array, and the charging and discharging of the control mode can be accomplished within 14 $\mu$s, the time typically available for a single row operation of an array with 1000 rows. Thus, the technique according to the invention of compensating for charge injection, leakage and other non-idealities can result in displays capable of robust operations.

FIGS. 6*a–e* illustrate capacitive gate current feedthrough in an organic FET, and mitigation of the feedthrough.

Figure 6A:
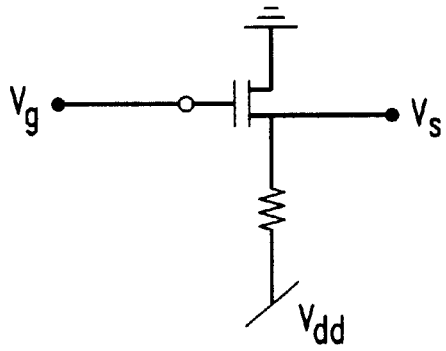
FIGS. 6*a* and 6*c* schematically show measurement circuitry used to determine the electrical characteristics of FIGS. 6*b*, 6*d* and 6*e;*
Figure 6B:
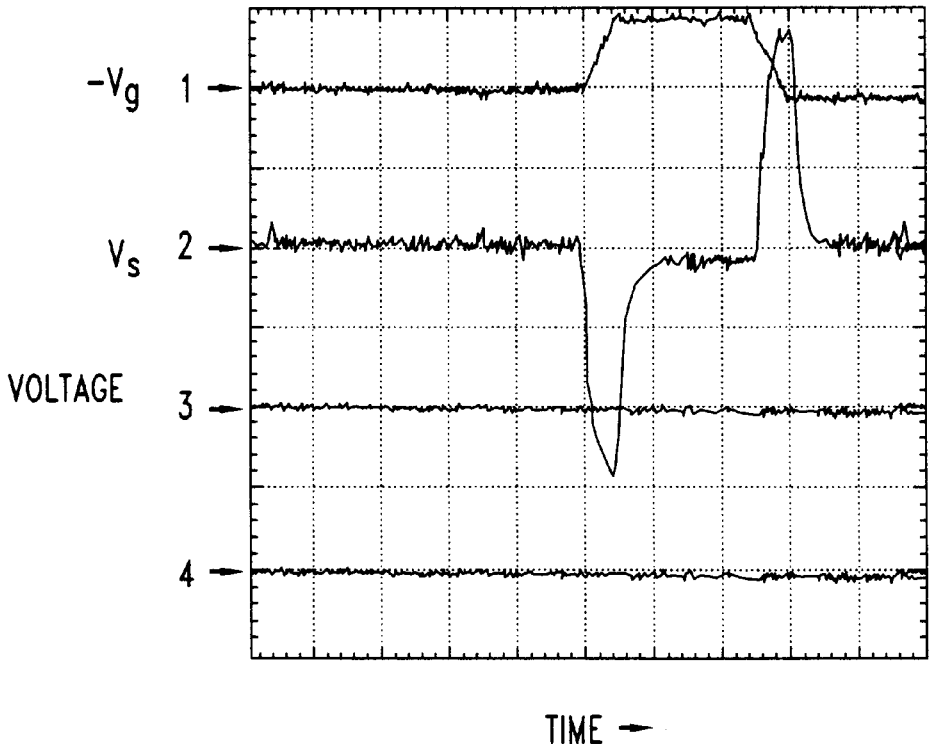
Figure 6C:
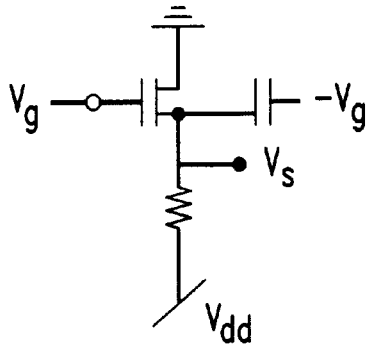
Figure 6D:
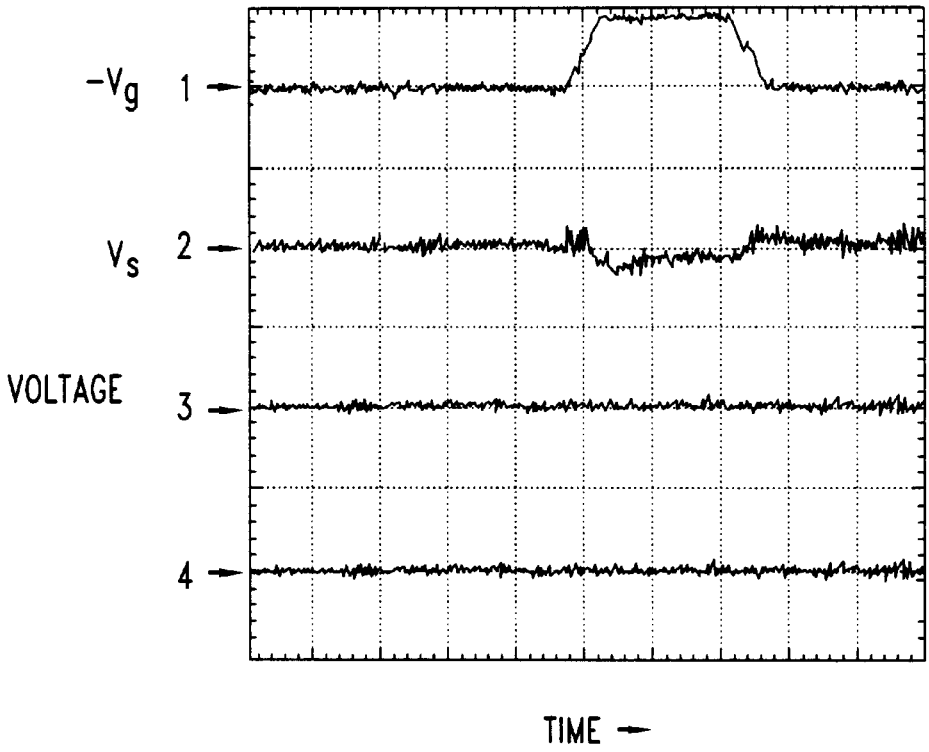
Figure 6E:
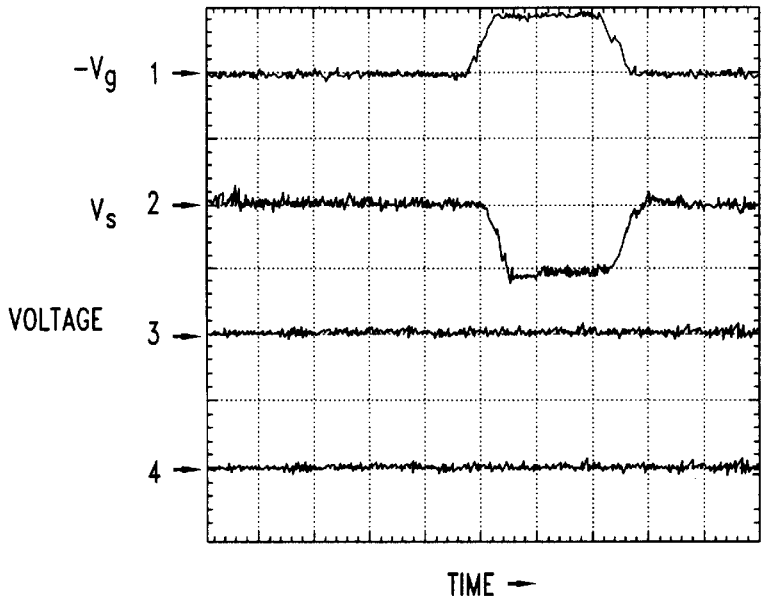

FIG. 6*a* schematically shows the measurement circuit that yielded the oscilloscope traces of FIG. 6*b*, for $V_{dd}$ =0. The effects of the capacitive signal feedthrough are seen in the impulsive glitches in $V_S$. FIG. 6*c* schematically shows the measurement circuit that yielded the traces of FIG. 6*d*, for $V_{dd}$=0. Providing dummy charge injection (i.e., applying a compensatory voltage to a capacitor connected to the source of the organic FET) greatly reduces the effect of the capacitive signal feedthrough. FIG. 6*e* shows the results obtained with the measurement circuit of FIG. 6*c*, but with a negative drain bias. The resulting characteristics are substantially ideal.

Having discussed a preferred approach to the substantial elimination of such non-idealities as capacitive signal feedthrough and charge leakage in organic smart pixels, we will next discuss a preferred approach to adaptive pixel control.

Adaptive Pixel Control

Figure 7:
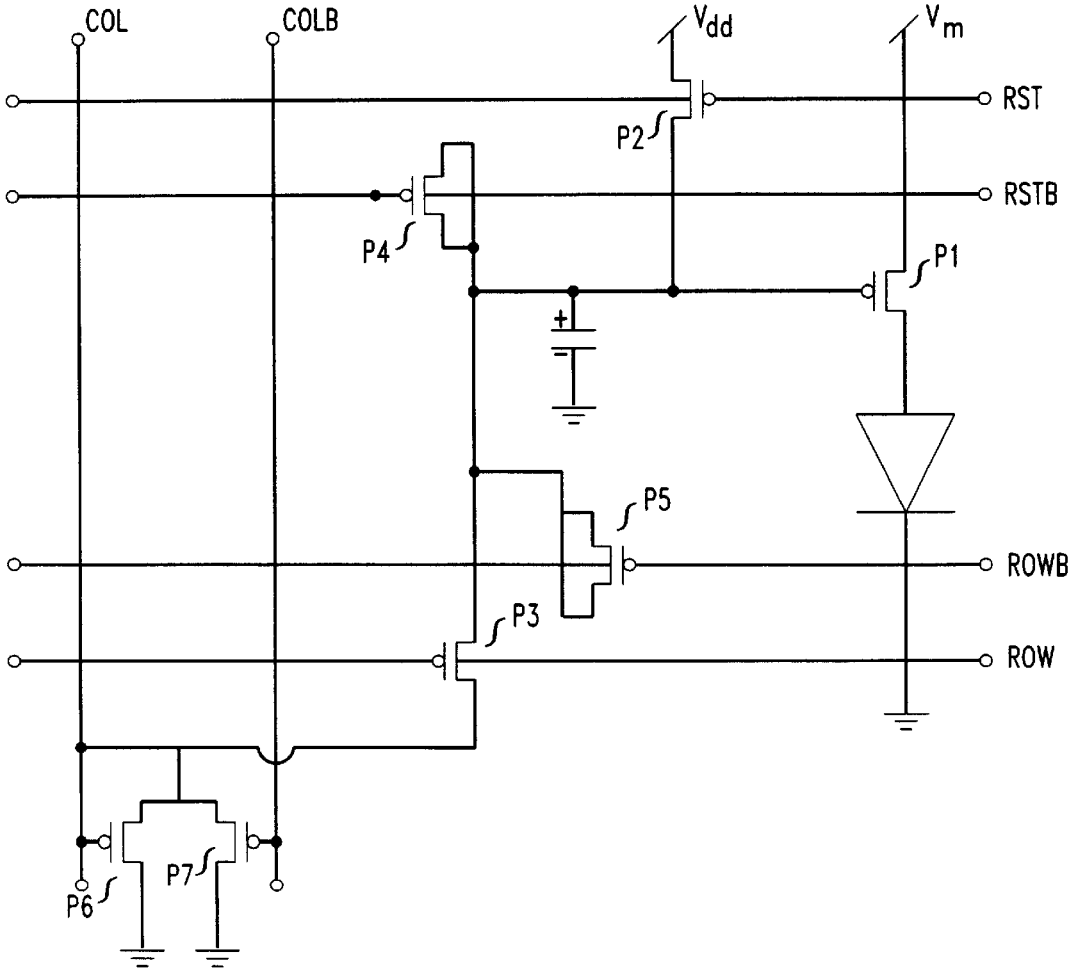
FIG. 7 schematically shows an organic smart pixel with relevant aspects of exemplary drive/compensation circuitry.

FIG. 7 schematically shows exemplary further drive/compensation circuitry that provides inter alia charge compensation and facilitates adaptive pixel control, as is shown below.

The circuit of FIG. 7 differs from that of FIG. 4 in that the former has two more FETs (P6 and P7), and in that there are two column lines (COL and COLB). P6 enables control of the discharge current in the pixel via a pulse width and pulse height variation of the COL voltage. In FIG. 4, the discharge current is varied via a voltage/current source control in series with the column line.

It will be appreciated that a display with adaptive pixel control according to the invention can run in two modes, to be designated the normal mode and the calibration mode. For example, the display typically is for a short time in the calibration mode whenever the display is turned on, or at predetermined intervals, e.g., once per day. After completion of the calibration, the drive/compensation circuitry switches the display into the normal mode. Of course, control of non-idealities, e.g., charge compensation, typically takes place both in the calibration and normal mode.

When the display is in the normal mode, a given row of pixels is activated and a gate voltage pulse is applied to all the P3 gates on the ROW line. A particular column is addressed by applying a column pulse to P6 (and a complementary column pulse to P7, to reduce clock feedthrough). The widths of the column pulse encode the display information, and the pulse heights encode stored calibration information for the given pixel.

When the display is in the calibration mode, a given row is activated, and the current flowing into P1 (at node $V_m$) of a given pixel is monitored (in a way to be described below). Based on the thus obtained measurements for all pixels in the given row, the column pulse heights for all pixels in the given row are adjusted to a desired value. This process is carried out for all rows. The calibration is performed for a range of column pulse widths so that the pulse heights stored during the calibration compensate effectively for pixel variations over a range of intensities.

Figure 8:
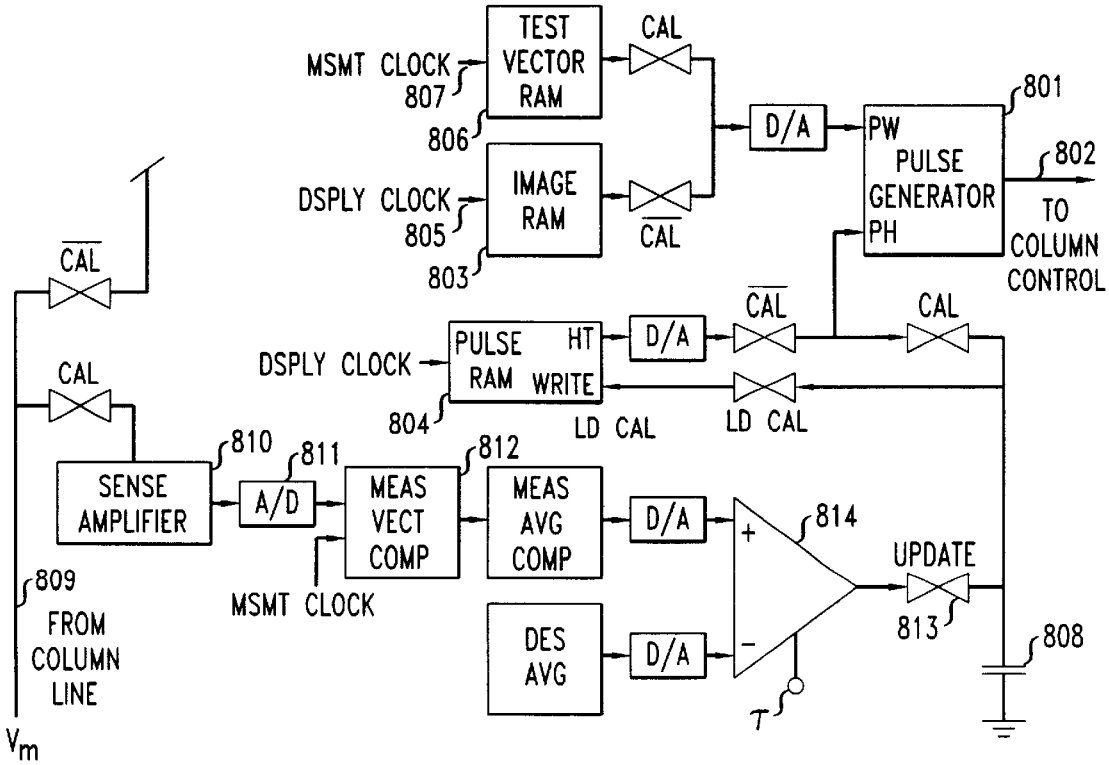
FIG. 8 schematically shows relevant aspects of exemplary drive/compensation circuitry.

FIG. 8 schematically shows a relevant portion of exemplary drive/compensation circuitry. It will be understood that such circuitry typically is connected to each column of a display according to the invention. Typically all the columns in a given row may be monitored and compensated by the drive/compensation circuitry in parallel. The drive/compensation circuitry of FIG. 8 typically is disposed in the second substrate region.

In FIG. 8, conventional transmission gates (indicated by an x-like symbol) are used to pass or block signals, based on the control voltage on their gate terminals. For instance, when the CAL signal is high, the display is in calibration mode and certain pathways in the circuitry are activated. On the other hand, when $\overline{CAL}$ is high then the display is in the normal mode and alternative pathways are activated.

The circuitry of FIG. 8 functions as follows. Pulse generator 801 outputs column pulses onto column control line 802 (COL), in accordance with its pulse width (PW) and pulse height (PH) control voltages. In the normal mode ( $\overline{CAL}$ high), these control voltages are obtained from image RAM 803 and pulse height RAM 804, respectively. These RAMs are cycled through the various rows of the display via a display clock (not shown) that provides a signal on display clock line 805. During calibration mode (CAL high), the pulse width information is obtained from test vector RAM 806 that cycles through various pulse width values in accordance with a measurement clock (not shown) that provides a signal on measurement clock line 807. The pulse height information is obtained from analog storage capacitor 808 that is updated via a feedback mechanism (to be described below) to converge to a desired value. Column line 809 ($V_m$) is routed to $V_{dd}$ in normal mode, and is routed to conventional sense amplifier 810 in calibration mode. The sense amplifier converts the LED current (i.e., the current through FET P1 in FIG. 4) in the pixel to a voltage. This voltage is digitized by A/D converter 811 and stored in measurement vector RAM 812. This RAM stores the results for the measurements for the various pulse widths that are output by test vector RAM 806, and for the current value of pulse height on analog storage capacitor 808.

Furthermore, a linear or non-linear average value of the measurements is computed by means of conventional digital arithmetic circuitry and compared with a desired average. The transconductance amplifier 814, whose bias current is set by $\tau$ (a voltage control "knob" that sets the bias current, and consequently the transconductance of the amplifier), then updates analog storage capacitor 808 to a pulse height that brings the average of the measurements closer to the desired value. The update is done during an update phase of the measurement clock (not shown), during which transmission gate 813 conducts. The process typically is repeated for many iterations until the pulse height has converged to a value around which it oscillates, and for which the desired average and the average of the measurements are sufficiently close.

The bias current of transconductance amplifier 814 and the value of storage capacitor 808 determine a speed/precision trade-off, i.e., how finely device parameter variations are being compensated for, and how quickly it can be done. Typically, the above-described feedback process is iterated a sufficient number of times to ensure convergence within an acceptable level of precision.

At the end of the convergence process the data on storage capacitor 808 is written into pulse height RAM 804 (when the LD and CAL signals are active at the end of the calibration) and the calibration is complete. At this point the drive/compensation circuitry typically is switched to the normal mode, and the display is ready for conventional use.

It will be understood that the above-described drive/compensation circuitry is exemplary, and that the objects of the invention can also be attained with other circuitry.

Figure 9:
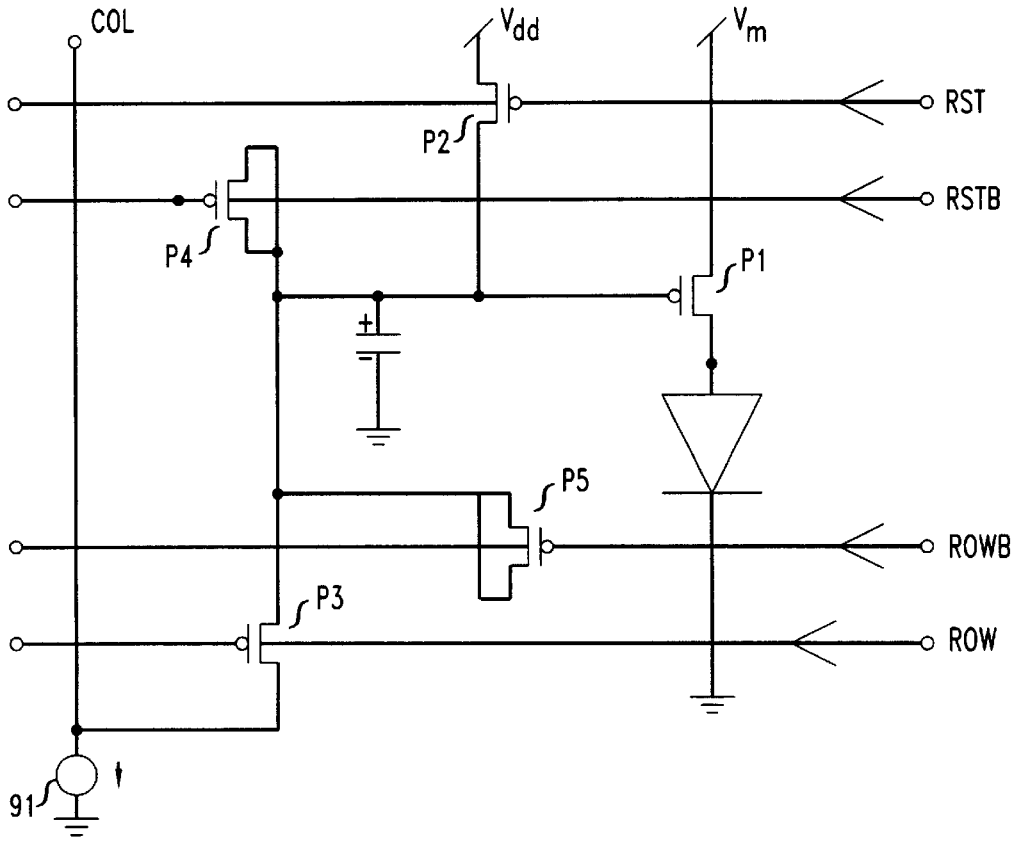
FIG. 9 schematically shows an organic smart pixel with relevant aspects of further exemplary drive/compensation circuitry.

For instance, alternate circuitry is shown in FIG. 9. As can be seen, the circuitry is similar to that of FIG. 7, but control is accomplished differently. Instead of P6 and P7 which control the current flowing through P3, in the circuit of FIG. 9 the current flowing through P3 is directly controlled by a current source 91. The value of $V_m$ measured in the calibration mode controls the current drawn through P3. Thus, instead of modulating the gate bias of P6 and P7, in the alternate drive/compensation circuitry the source current of P3 is modulated directly.

Figure 10:
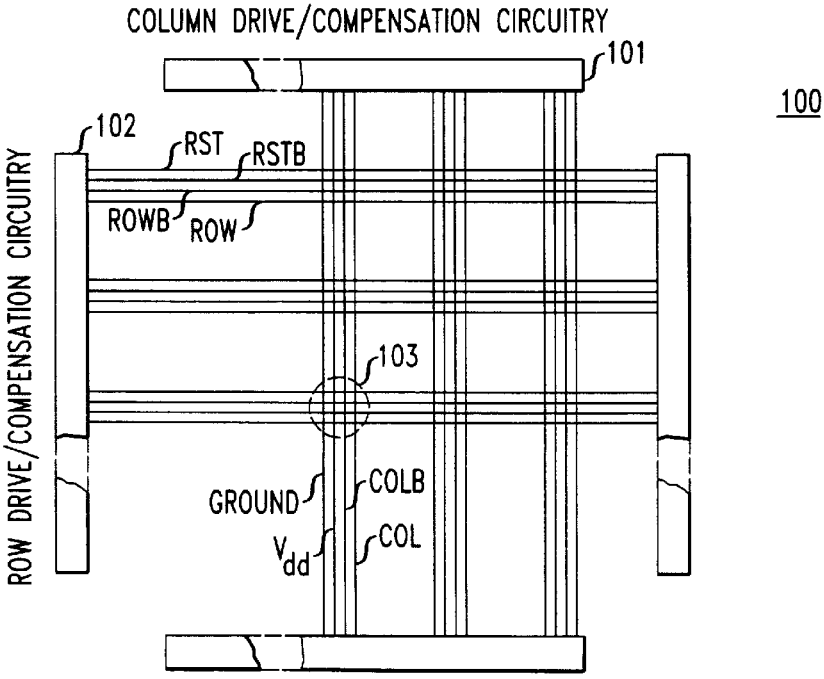
FIG. 10 schematically depicts relevant aspects of active matrix display apparatus according to the invention.

FIG. 10 schematically depicts exemplary display apparatus 100 according to the invention. The apparatus comprises a multiplicity of row and column conductor lines, column drive/compensation circuitry and row drive/compensation circuitry. Each intersection of the row and column lines is associated with a pixel, exemplarily with circuitry as shown in FIG. 7. The pixels are disposed on the first substrate region, and the column and row drive/compensation circuitry is disposed on the pixel-free second substrate region. By way of example, the row conductor lines comprise ROW, ROWB, RST and RSTB, and the column conductor lines comprise COL, COLB, $V_{dd}$ and Ground.

The discussion above is primarily in terms of pixel FETs having organic active material. However, the invention is not thus limited, and pixel transistors with inorganic (e.g., amorphous or polycrystalline Si) active material are contemplated. The terms "organic" and "inorganic" have their conventional meaning herein.

It will be noticed that the drive/compensation circuit diagrams herein show p-channel FETs. However, this is just a matter of design choice, and the invention could be practiced with n-channel FETs or with p-channel and n-channel FETs.

The prior art knows a variety of materials that can be used to form an organic LED and/or a pixel FET. Among them are oligothiophene, pentacene, Di—R-anthradithiophene wherein R is either $C_mH_{2m+1}$ wherein m is 0 to 18 or $C_yH_{2y+1}OC_zH_{2z}$ where z+y=4 to 17, y is greater than zero, and z is greater than 2, bis-benzodithiophene, phthalocyanine coordination compounds, and regioregular poly(3-alkylthiophene). Among particularly preferred materials are poly(phenylene vinylene) (PPV), bis(triphenyl diamine) (TAD), tris (8-hydroxy quinolinato) aluminum (Alq), and bis (10-hydroxybenzo quinolinato) beryllium.

What is claimed is:

1. Display apparatus comprising:

a first substrate region having a multiplicity of nominally identical smart pixels; and a smart pixel-free second substrate region; and wherein each smart pixel comprises:

a) an organic light emitting diode; and b) pixel circuitry for providing a current through the organic light emitting diode, the pixel circuitry comprising at least one field effect transistor connected in series with the organic light emitting diode;

characterized in that c) the field effect transistors are organic transistors; and d) the display apparatus comprises drive/compensation circuitry that mitigates one of transistor gate capacitive signal feed-through and transistor gate leakage currents that produce adverse effects on said smart pixels, a portion of said drive/compensation circuitry being disposed in said second substrate region.

2. Display apparatus according to claim 1, wherein said drive/compensation circuitry comprises C-MOS circuitry.

3. Display apparatus according to claim 1, wherein said drive/compensation circuitry mitigates gate capacitive signal feed-through in said field effect transistors.

4. Display apparatus according to claim 3, wherein said drive/compensation circuitry is selected to mitigate said capacitive signal feed-through by injection of a compensating charge into the gate terminal of the field effect transistor.

5. Display apparatus according to claim 1, wherein said drive/compensation circuitry corrects one or more of pixel-to-pixel brightness variations and time-dependent pixel-brightness variations.

6. Display apparatus according to claim 1, wherein said drive/compensation circuitry mitigates gate leakage currents in said field effect transistors.

7. Display apparatus according to claim 1 wherein said drive/compensation circuitry is selected to mitigate said charge leakage by setting a pixel ROW signal to an inactive high value and a pixel reset signal to a value above a drain supply voltage.

8. Display apparatus according to claim 1, wherein said drive/compensation circuitry measures, at predetermined intervals that are longer than a frame period of the display apparatus, one or more characteristics of each smart pixel and sets voltages applied to gates of said field effect transistors such that substantially all smart pixels have substantially the same light emission for a given signal provided to the display apparatus.

9. Display apparatus according to claim 8, wherein said drive/compensation circuitry mitigates the capacitive signal feed-through by injection of a compensating charge into the gates and mitigates the charge leakage by setting pixel ROW signals to inactive high values and pixel reset signals to values above a drain-supply voltage.

10. Display apparatus comprising:

a first substrate region having a multiplicity of nominally identical smart pixels; and a smart pixel-free second substrate region; and wherein each smart pixel comprises:

a) an organic light emitting diode; and b) pixel circuitry for providing a current through the organic light emitting diode, the pixel circuitry comprising at least one field effect transistor connected in series with the organic light emitting diode;

characterized in that c) the field effect transistors are organic transistors; and d) the display apparatus comprises drive/compensation circuitry that mitigates adverse effects on said smart pixels by one or more non-idealities inherent to the organic transistors and/or organic light emitting diodes, a portion of said drive/compensation circuitry being disposed in said second substrate region, the drive/compensation circuitry being configured to measure a characteristic of each smart pixel.

11. Display apparatus according to claim 10, wherein said drive/compensation circuitry is configured to remeasure the characteristic of one of the smart pixels, at predetermined intervals that are longer than a frame period of the display apparatus.

12. Display apparatus according to claim 10, wherein said drive/compensation circuitry is configured to measure the characteristic of one of the smart pixels intermittently.

13. Display apparatus according to claim 10, wherein the drive/compensation circuitry is configured to store data on one of the smart pixels in a memory in response to measuring the characteristic of the one of the smart pixels.

14. Display apparatus according to claim 10, wherein said drive/compensation circuitry is configured to measure the characteristic of one of the smart pixels by applying pulses with different pulse heights to the one of the pixels.

15. Display apparatus of claim 10, wherein said drive/compensation circuitry sets voltages applied to gates of said field effect transistors in a manner that is responsive to said measurements on associated ones of said smart pixels.

16. Display apparatus of claim 10, wherein the drive/compensation circuitry is configured to mitigate one of transistor gate capacitive signal feed-through and transistor gate leakage current.

* * * * *